United States Patent [19]

Riordan

[11] 4,192,247

[45] Mar. 11, 1980

[54] SAILING VESSEL

[76] Inventor: John E. Riordan, 7855-Blvd. East, 11B, N. Bergen, N.J. 07047

[21] Appl. No.: 921,984

[22] Filed: Jul. 5, 1978

Related U.S. Application Data

[63] Continuation-in-part of Ser. No. 807,670, Jun. 17, 1977, abandoned.

[51] Int. Cl.[2] ..... B63B 35/00

[52] U.S. Cl. ..... 114/39; 114/61; 114/91; 114/123

[58] Field of Search ..... 114/39, 61, 90, 91, 114/123, 283, 284

[56] References Cited

U.S. PATENT DOCUMENTS

| | | | |
|---|---|---|---|
| 3,509,842 | 5/1970 | Mitchell | 114/39 |
| 3,566,819 | 3/1971 | Keddie | 114/61 |
| 3,954,077 | 5/1976 | Piat-Marchand | 114/123 |

FOREIGN PATENT DOCUMENTS

| | | | |
|---|---|---|---|
| 195022 | 3/1906 | Fed. Rep. of Germany | 114/123 |
| 1455644 | 9/1966 | France | 114/39 |

*Primary Examiner*—Sherman D. Basinger
*Attorney, Agent, or Firm*—Ernest F. Marmorek

[57] ABSTRACT

A triple-hulled sailing vessel has a mast on its center hull. The lower end of the mast is pivotally connected to the center hull and a rigid transverse brace is connected to the central hull so that it pivots as the mast pivots; the outer ends of the brace are pivoted to the respective flanking hulls. Links are pivoted to the flanking hulls; these links extend upwardly towards the mast and are pivoted to a connecting member which is secured to it; the pivot axes being located adjacent to, but at opposite sides of the mast. Springs are interposed in these links and also in the brace; in the latter they are provided at locations intermediate the center hull and the flanking hulls. This construction increases the self-righting ability of the vessel under the heeling influence of wind, making the structure stable throughout its heelable range.

7 Claims, 2 Drawing Figures

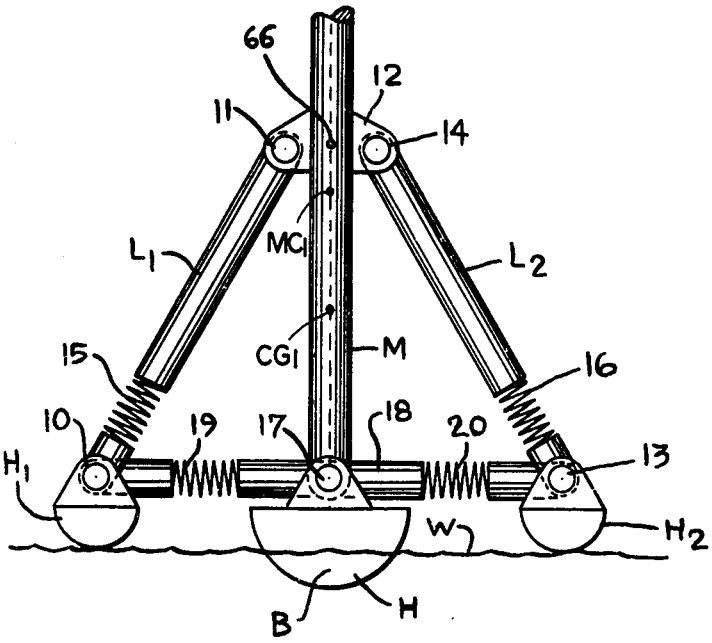
Fig 1
Fig 2
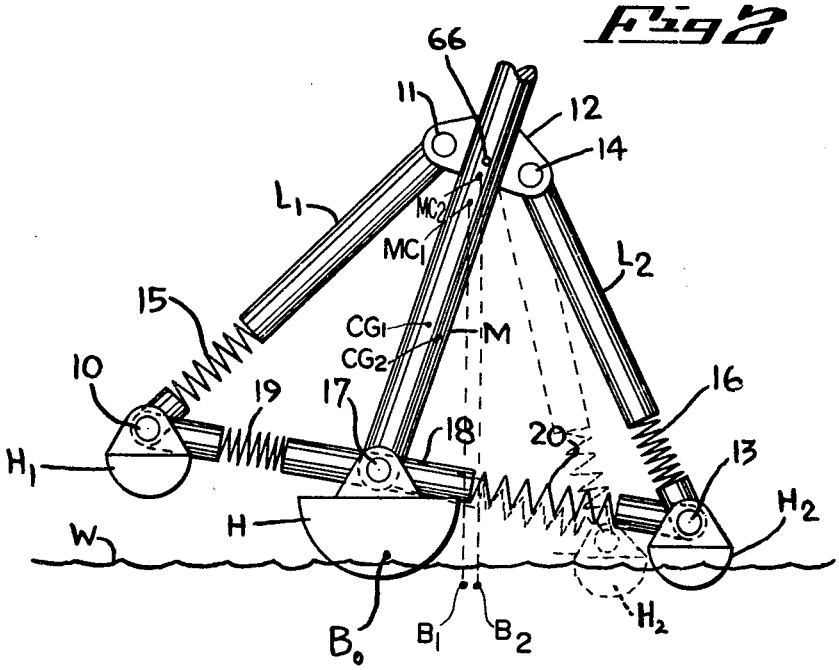

SAILING VESSEL

CROSS REFERENCE TO RELATED APPLICATIONS

This application is a continuation-in-part of the copending application Ser. No. 807,670, filed June 17, 1977 now abandoned.

BACKGROUND OF THE INVENTION

This invention relates to a sailing vessel generally, and in particular to a multi-hull sailing vessel.

More specifically, the invention relates to a three-hull sailing vessel, i.e., a vessel having a center hull and two flanking hulls. The word "hull" as used herein is not restricted to a hollow hull but can also refer to a solid hull having flotation capabilities (e.g., a Balsa outrigger float).

The conventional single-hull sailing vessels, wherein the hull is ballasted, can heel over under the pressure of wind to a very substantial degree (close to 90°) before they capsize. Since sailing vessels must be able to operate safely even in severe weather, this is an important feature.

Triple-hull vessels, on the other hand, i.e., the type of vessel having a center hull which is flanked at its opposite lateral sides by outrigger hulls, tend to capsize when the heeling angle of the vessel is greater than about 26° relative to the vertical. This is a decisive disadvantage, not only in terms of general handling of such vessels but in terms of the safety—or rather lack thereof—of triple-hull sailing vessels.

SUMMARY OF THE INVENTION

It is therefore an object of the invention to improve the safety, the righting moment and the handling characteristics of triple-hull sailing vessels of the type mentioned above.

More particularly, it is an object of the invention to provide an improved triple-hull sailing vessel which is able to undergo heeling through angles up to 90° without capsizing, i.e., which has self-righting ability within this heeling range.

An additional object is to provide a sailing vessel of this kind wherein the improved heeling ability is the result of an arrangement which is simple and relatively inexpensive.

In keeping with these and other objects, the invention provides a sailing vessel having a center hull flanked by two outrigger hulls; a mast mounted on the center hull for pivoting movement about a first pivot axis extending longitudinally of the center hull; a transverse brace pivoted to the center hull for pivoting movement with the mast about the first pivot axis and having outer ends pivoted to the outrigger hulls for pivoting movement about respective second pivot axes each extending longitudinally of the respective outrigger hull; a pair of rigid links each having a lower end secured to one of the outrigger hulls for pivoting about the respective second axes and having upper ends pivoted to the mast upwardly spaced from the center hull by a predetermined distance; and elastically extensible elements interposed in each of the links and in the transverse brace at opposite sides of the center hull intermediate the same and the respective outrigger hull.

The invention will now be described with reference to an exemplary embodiment of the invention as shown in the appended drawings, but is not to be considered limited thereto.

BRIEF DESCRIPTION OF THE DRAWING

FIG 1 is a diagrammatic end view of a vessel embodying the invention, the vessel being shown in normal upright position; and FIG. 2 is a view similar to that in FIG. 1, but showing the vessel in heeled-over position.

DESCRIPTION OF THE PREFERRED EMBODIMENT

The embodiment shown in FIGS. 1 and 2 is of a sailing vessel for use in water; but would be equally applicable to other sailing vessels, such as ice boats.

The vessel has a center hull H which is flanked at its opposite sides by two outrigger hulls $H_1$ and $H_2$. The water level is indicated by the reference character W. The relative size of the hulls is exemplary only; as a general rule it is, however, true that in such triple-hulled vessels the center hull is larger than the outrigger hulls which usually only have a stabilizing (not passenger-carrying) function.

Mounted on the center hull H is the mast M on which the sail or sails (not shown) will be hoisted. Mast M is only partly shown, i.e. to the extent necessary for an understanding of the invention.

The mast M is pivoted to the center hull H at 17, for pivotal movement about a pivot axis (defined by pivot 17) which extends lengthwise of the hull H (i.e. normal to the plane of FIGS. 1 and 2). Also mounted on hull H for pivoting about pivot 17 together with the mast M, is a transverse brace 18, the opposite outer ends of which are pivoted to the hulls $H_1$ and $H_2$, respectively, for relative pivoting about the pivot axes 10 and 13 which extend lengthwise of the hulls $H_1$ and $H_2$, respectively.

Two rigid links $L_1$ and $L_2$ are provided each having a lower end connected to one of the hulls $H_1$ and $H_2$; the links can thus pivot about the pivot axes 10 and 13, respectively. The upper ends of the links $L_1$ and $L_2$ are pivoted at 11 and 14, respectively, to a connecting member 12 which is mounted on the mast M at a predetermined distance above the hull H.

Interposed in the links $L_1$ and $L_2$ (and connected to them is suitable manner which forms no part of the invention, since it involves only conventional fastening techniques) are respective helical expansion springs 15 and 16. Similarly interposed in and connected to the transverse brace 18 are helical expansion springs 19,20; these latter are located at opposite sides of the hull H, intermediate the same and the outrigger hulls $H_1$ and $H_2$, respectively.

This arrangement takes account of the desired righting moment for the vessel, which can be calculated as follows:

$$RM = \sum_{i=1}^{i=n} wgt_i \times (X_i)$$

wherein $X_i$=distance of element i from CG:

$wgt_i$=height of element;

RM=the righting moment; and

CG=center of gravity

In multi-hull vessels according to the prior art, this favorable relationship does not exist. In these vessels the meta center moves away from the vertical longitudinal centerline of the vessel as the vessel heels over, until only one of the displacing components (outrigger hulls) remains in the water. From that moment on the horizontal distance between meta center and center of gravity shown in FIG. 1 as $B_o$ and CG respectively begins to decrease as heeling-over progresses, and with this decrease in the distance there occurs a decrease in the righting moment. In other words, the further the vessel heels over after the decrease begins, the less it is able to right itself. This occurs at a heeling angle relative to the vertical which is much smaller than 90° and may be as small as about 26°; it results in capsizing of the vessel.

This problem is overcome with the disclosed invention and the vessel is made stable throughout the heelable range of 90°; i.e. it is able to right itself throughout this range.

This advantage results from the fact that the disclosed vessel is able to maintain a large horizontal meta center—center of gravity distance when heeling; even more importantly, this distance actually increases with an increasing angle of heel.

Thus, a comparison of FIG. 2 (showing the vessel heeling to the right) with FIG. 1 (shown in non-heeling state) shows that during heeling-over of the vessel that the helical spring in brace 18 which is located on the side towards which the vessel heels (here the spring 20) becomes elastically stretched so that the distance between hulls $H_1$ and $H_2$ increases. The hull H itself does not heel at all, since the mast M and the brace 18 can pivot relative to it about the pivot axis 17. This permits the other hull (here $H_1$) to be raised out of the water W with slight compression (or no compression) of the spring 19. The spring 15 in link $L_1$, however, becomes elastically stretched due to the pivoting of mast M against the weight of hull $H_1$, whereas the spring 16 either remains unchanged or becomes slightly compressed.

The pivots 11, 14 connecting the links with the mast M are secured to the mast at a specific location, a point corresponding to the level of the center of effort or inertia 66 of the sail. The novelty of the invention will be best understood from a perusal of FIG. 2. Shown only on the right-hand side of FIG. 2 in dotted lines is a configuration the vessel would assume if the springs 16 and 20 were to remain rigid, namely would not yield under tension, which configuration corresponds to the prior art. In that case the metacenter $MC_1$ is obtained in a well-known manner, and is defined by the intersection between a first vertical line through the center of buoyancy $B_o$ when the vessel is in equilibrium, and a second vertical line through an effective new center of buoyancy $B_1$ when the hull is slightly inclined towards one side; the first originally vertical line then becoming tilted by the inclination of the vessel so as to yield the intersection point $MC_1$ defining the metacenter. The distance of the intersection point $MC_1$ above the center of gravity CG is then an indication of the initial stability of the vessel. It will be observed that the effective center of buoyancy $B_1$ will actually occur outside the hulls H and $H_2$.

The inventive concept is illustrated in full lines in FIG. 2. It will be seen that the new center of gravity $CG_2$ has shifted slightly to the right of the original center of gravity $CG_1$ as a result of the extended distance of the hull $H_2$ from the hull $H_1$, and that consequently the effective new center of buoyancy $B_2$ occurs further to the right from the effective center of buoyancy $B_1$, which would have existed had the spring 20 not been extended under stress. This, in turn, yields a new effective metacenter $MC_2$ disposed at a greater distance from the corresponding new center of gravity $CG_2$ than the distance of the prior art postulated metacenter $MC_1$ from the effective center of gravity $CG_1$ when the vessel is in equilibrium position. It will be appreciated that the horizontal distance between the effective centers of gravity and a point about which the vessel rotates, when heeling, will increase as the angle of heel increases. Hence, the present inventive concept results in an increase of the distance between the effective metacenter, and the effective center of gravity of the vessel.

The invention has been explained with reference to a specific illustrated embodiment. However, it should not be considered limited to the same, because various changes can be made within the inventive concept. For example, the helical springs could be replaced by other elastically extensible elements; they also need not be located at the precise positions alon the links and brace, i.e. they might be located closer to one of the other end of these elements.

What is desired to be protected by Letters Patent is set forth in the appended claims.

I claim:

1. A sailing vessel, having an effective center of gravity and an effective metacenter, said center of gravity and said metacenter being spaced from one another at a predetermined distance comprising:

a longitudinal center hull and two outrigger hulls flanking said center hull at opposite lateral sides of the same, a mast mounted on said center hull;

a first pivot mounting a lower end of said mast to said center hull for pivotal movement about a first axis extending lengthwise of said center hull;

a first elongated member including a transverse brace mounted on said center hull for pivotal movement about said first axis;

second pivots mounting lateral ends of said transverse brace to said outrigger hulls respectively, for pivotal movement about respective second axes extending substantially parallel to said first axis; and second elongated members, each including a rigid link having a lower end portion pivoted to a respective outrigger hull for movement about the respective second axis, and each having an upper end pivoted to said mast and upwardly spaced from said center hull for pivotal movement about a respective third pivot axis substantially parallel to said first and second axes, said upper ends being located at opposite sides of said mast.

2. A sailing vessel as claimed in claim 1, and further comprising elastically extensible means interposed in at least some of said elongated members.

3. A sailing vessel as claimed in claim 2, wherein said elastically extensible means interconnect portions of said brace and thereby connect said hulls with one another and with said mast in a manner so that the horizontal distance between the center of gravity and a point about which the vessel rotates when heeling, increases as the angle of heel increases.

4. A sealing vessel as claimed in claim 2, wherein said elastically extensible means comprise helical expansion springs.

5. A sailing vessel as claimed in claim 2, wherein each elongated member is in the form of a longitudinally interrupted bar having two sections which are connected by said elastically extensible means.

6. A sailing vessel as claimed in claim 2, wherein said brace is in the form of a bar having a center section pivoted to said center hull and two separate end sections each pivoted to one of said outrigger hulls, each of said end sections being connected to said center section by said elastically extensible means.

7. A sailing vessel as claimed in claim 1, wherein said sailing vessel has a center of effort and said upper ends of said links are pivoted to said mast substantially at the center of effort.

* * * * *